United States Patent [19]

Hall

[11] Patent Number: 4,519,019

[45] Date of Patent: May 21, 1985

[54] CEILING LIGHT FITTING

[75] Inventor: Stephen M. Hall, London, England

[73] Assignee: Quantum Lighting Limited, England

[21] Appl. No.: 602,492

[22] Filed: Apr. 20, 1984

[30] Foreign Application Priority Data

Apr. 22, 1983 [GB] United Kingdom ..... 8311075

[51] Int. Cl.[3] ..... F21S 1/02

[52] U.S. Cl. ..... 362/147; 362/148; 362/217; 362/218; 362/281; 362/294; 362/297; 362/298; 362/301; 362/323; 362/341; 362/346; 362/347; 362/364; 362/373

[58] Field of Search ..... 362/147, 148, 218, 217, 362/297, 298, 294, 301, 281, 323, 341, 346, 347, 364, 373

[56] References Cited

U.S. PATENT DOCUMENTS

| | | | |
|---|---|---|---|
| 3,643,089 | 2/1972 | Marantz | 240/78 H |
| 4,042,817 | 8/1977 | McNamara, Jr. | 240/9 R |
| 4,349,866 | 9/1982 | Molnar | 362/147 X |
| 4,475,147 | 10/1984 | Kristofek | 362/147 X |

FOREIGN PATENT DOCUMENTS 1249905 11/1960 France .

OTHER PUBLICATIONS

ASPECT Ceiling/Lighting System catalog, Apr. 22–30, 1983.

*Primary Examiner*—Stephen J. Lechert, Jr.
*Attorney, Agent, or Firm*—Wigman & Cohen

[57] ABSTRACT

A ceiling light fitting has three extended, constant-section reflectors which are parallel to the wall, the reflector being swingable back to enable the lamp to be changed. The lamp filament is linear and parallel to the wall. The reflectors are of part-circular section and enhance the light, as well as the reflector acting as a mask to prevent the filament being seen from behind the fitting. The reflector projects very little below ceiling level. The reflector is parabolic with the filament at its focus, the axis of the parabola being directed at the base portion of the wall. The reflector faces downwards and has at least its major part above the level of the filament and on the wall side of the filament.

12 Claims, 5 Drawing Figures

FIG. 1.
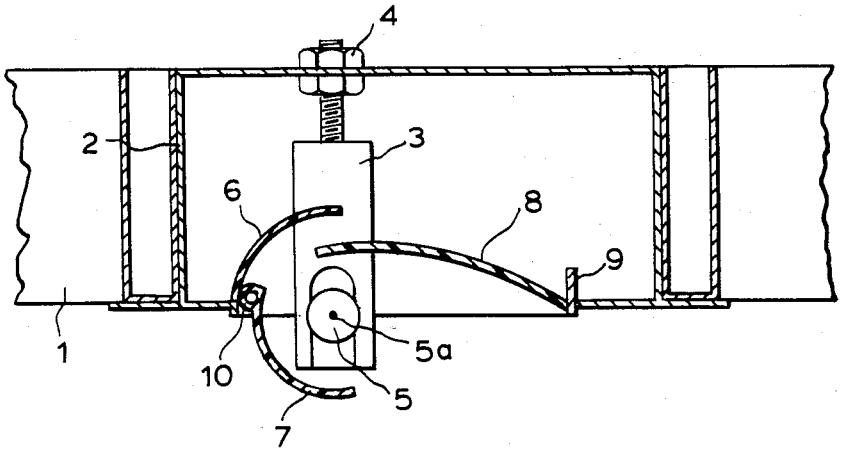
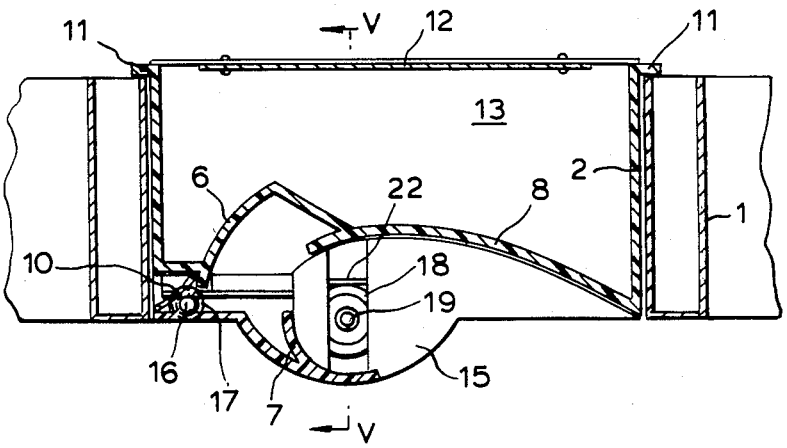
FIG. 3.

CEILING LIGHT FITTING

BACKGROUND OF THE INVENTION

The present invention relates to a ceiling light fitting for lighting a wall, known in the art as a "wall washer". The light fitting has means (which may be termed a chassis) for mounting the fitting in the ceiling, holding means for holding a lamp in the fitting and a reflector for directing reflected light towards the base portion of the wall.

The intention of ceiling light fittings of this type is to light a side wall of a room evenly from top to bottom and from side to side with a cut-off at the top so that there are no streaks of light along the ceiling; in practice, the eye will accept significant variations in illumination, but there is still a problem in directing enough light to the base of the wall to prevent it appearing rather darker than the top part. It is also required that the light fitting should be as unobtrusive as possible, that the light output should be used efficiently and that the light source itself should be shielded from sight of the occupants of the building. In many cases the most convenient place for the light fitting is to recess it in the ceiling above the wall to be illuminated. This creates some problems with the light distribution which must be solved in the design of the light fitting: the areas of the wall closest to the fitting are too brightly illuminated and the top edge of the wall is difficult to illuminate from a fitting recessed above the ceiling plane. Some existing fittings intended for this purpose for instance utilise lamps mounted vertically in reflectors in the ceiling fitting from which light is directed towards the bottom of the wall with a small reflector in the mouth of the fitting below the ceiling level which redirects some of the light towards the top of the wall; the reflector may be curved in two planes at right angles, projecting down beneath the lamp on the side of the lamp opposite to the wall. In another arrangement, a light with a parabolic reflector is used with a shield for hiding the filament or other light source of the lamp when one looks up at the fitting.

The problem with such lamps is that the illumination is greatest on the wall directly opposite the lamp and falls away rapidly—illumination tends to be poor at the base of the wall. If (as is usual) a number of lamps are used spaced along the ceiling, uneven illumination is obtained where beams are superimposed and at the edges of beams—one can obtain a pattern along the top portion of the wall like a cusped arcuate fringe. A further disadvantage of these arrangements is that the lamps project significantly below ceiling level and are rather obtrusive.

In general terms, the object of the invention is to provide an improved ceiling light fitting for lighting a wall and more particularly for ensuring adequate and even illumination at the base of the wall and at the top of the wall.

THE INVENTION

An extended, generally concave, downwards-facing, constant section reflector is positioned above the light source, for directing reflected light towards the base of the wall.

By positioning the lamp accurately, the beam from the lamp can be controlled to cover the wall up to its junction with the ceiling and be cut off at that line. The wall is illuminated by light direct from the lamp and e.g. that which is reflected back through the lamp. By having the light source roughly at ceiling level and positioning the major part of the reflector above the level of the light source (roughly horizontally) and between the light source and the wall, the light reflected from the reflector is directed towards the base portion of the wall, thereby compensating for the natural decrease in illumination of the wall towards its base. Furthermore, the position of the reflector ensures that it is mainly above ceiling level and therefore unobtrusive. By having an extended reflector of substantially constant section, the cusped arcuate fringe effect is greatly reduced; by suitable positioning of a number of spaced light fittings in line, the effect may not be apparent. The invention thus provides for the efficient use of the light output of the lamp, even illumination of the wall and an acceptably small projection below the ceiling plane. The light source can be concealed from sight of occupants of the building.

PREFERRED EMBODIMENTS

The invention will be further described, by way of example, with reference to the accompanying drawings, in which:

FIG. 1 is a vertical section through a prototype, also showing part of the ceiling in which it is mounted;

FIG. 3 is a vertical section along the plane III—III in FIG. 2, showing part of the ceiling system;

FIG. 1

Figure 2:
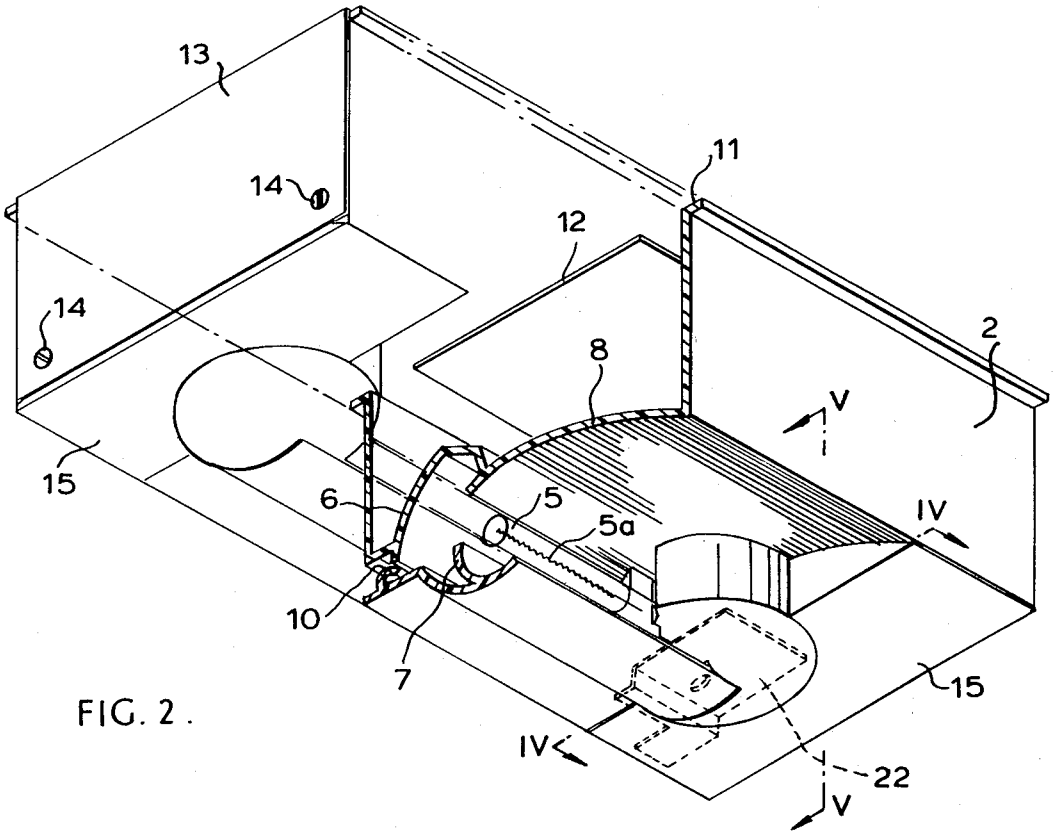
FIG. 2 is an isometric projection of an improved fitting, showing a vertical section through the reflectors and part in ghost lines.

A cellular suspended ceiling 1 is shown, of the type described in GB No. 1 472 285 or GB No. 2 122 666A, formed by intersecting elongate members or blades defining a grid. The light fitting has mounting means in the form of a box or chassis 2 which for example fits into a rectangular cell formed between four blades of the suspended ceiling 1, the bottom plate lying flush against the underside of the ceiling 1; the chassis 2 can be formed of cast aluminium. The chassis 2 mounts holding means or lamp holders 3 (having a conventional, independant height adjustment 4) for mounting each end of a tubular lamp 5 with a linear light source or filament 5*a*, the filament 5*a* being horizontal and roughly at ceiling level, and also parallel to the wall being illuminated—the wall is not shown but will be to the right of the fitting.

A reflector system is formed by three reflectors 6,7,8 positioned around and partially enclosing the lamp 5. Each of them may be formed of extruded aluminium, e.g. subsequently brightened and anodised. Each reflector 6,7,8 is of constant section. The reflectors 6,7 are of part-circular section, carried on the filament 5*a*, and have a specular surface. The reflector 8 faces generally downwards and has its major part roughly horizontal and positioned above the level of the filament 5*a* and on the wall side of the filament 5*a*, the section being generally concave. The reflector 8 is more specifically shown as being of parabolic shape with the filament 5*a* on the axis of the parabola and at its focus. The axis of the parabola is at roughly 30° to the vertical, being inclined downwards to the right. In theory therefore the reflector 8 should direct a beam of reflected light parallel to its axis, towards the base portion of the wall. However, in order to soften the edges of the beam and give some spread, and also in order to break up the pattern of the filament in the beam, the surface of the reflector 8 can be textured. for instance by shot-blasting, i.e. being non-specular.

The reflectors 6,7 reflect the light back through the lamp 5 and thus enhance the light. However, the reflector 7 also acts as masking means for preventing the filament 5*a* being seen from directly below and more particularly from positions which are to the left of the vertical through the filament 5*a*. When the fitting is correctly positioned, only the wall is illuminated.

The filament 5*a* will be spaced 1–1.2 meters from the wall. If the fitting is too far from the wall, it is easy to look up into the beam of light, which is undesirable; if the fitting is too close to the wall, only a glancing beam is emitted, which highlights defects on the wall and makes it difficult to obtain even illumination. Nonetheless, the fitting shown is designed for a ceiling height of roughly 2.4–3.5 meters, and in general terms the greater the height, the further away from the wall the fitting should be. If a long wall is being illuminated, a number of fittings can be used, spaced in alignment with each other. The spacing depends on the height of the wall, the distance of the fitting from the wall and the intensity required, but a typical spacing (pitch) is two to three meters.

In detail, the left-hand edge of the reflector 8 is adjacent and slightly to the left of the vertical plane through the filament 5*a*, and the reflector 6 extends above the level of the reflector 8 and has its right-hand edge adjacent and slightly to the right of said vertical plane, thus overlapping but being spaced above the left-hand edge of the reflector 8; this leaves a gap for the circulation of cooling air without allowing the direct escape of light. The reflector 7 extends below the level of the filament 5*a*. The reflector 6 is of greater radius than the reflector 7, the difference in radii being approximately equal to the distance between the reflecting surfaces of the reflectors 6 and 8 where they overlap.

The right-hand edge (the edge nearer the wall) of the reflector 8 is approximately at the same level as the ceiling 1. However, in order to align the top edge of the beam of light from the fitting with the junction between the wall and ceiling (and prevent streaks of light on the ceiling 1), a height-adjustable shield 9 is provided.

The reflector 9 can be arranged to be swung clockwise away from the lamp 5 for replacement of the lamp, being carried by pivot pins which engage small lugs 10.

It is not necessary that the reflecting surface of the reflector 8 should be parabolic—for instance an elliptical surface could be used or the surface could be formed up of a series of flats approximating to a curve, which assists in diffusing the edges of the beam.

Although the reflectors 6,7 enhance performance, they could be omitted.

As long as the reflector 8 is of extended, constant section, it would be possible to use one point source of light or a number of point sources spaced along the fitting.

FIGS. 2–4

Figure 4:
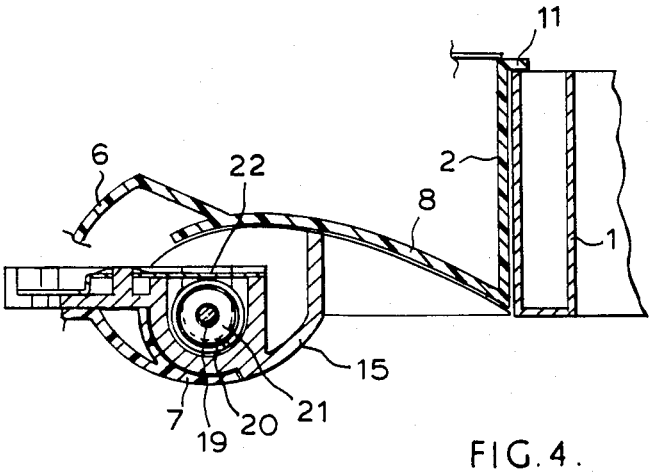
FIG. 4 is a part vertical section along the plane IV—IV in FIGS. 2 and 5.
Figure 5:
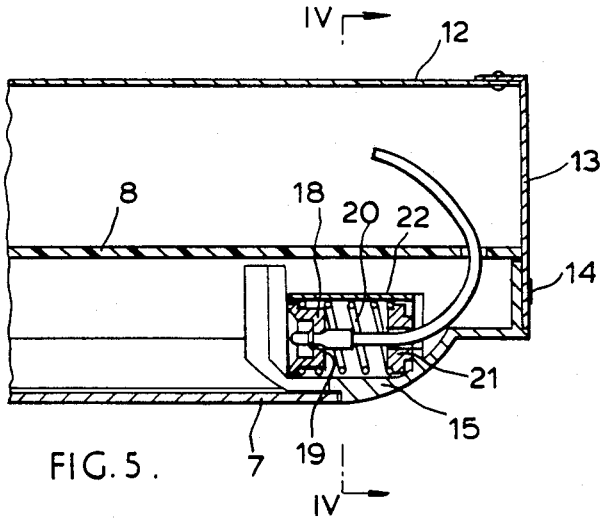
FIG. 5 is a part vertical section along the plane V—V in FIGS. 2 and 3.

Many parts of the fitting of FIGS. 2–4 are very similar to those of FIG. 1, and the same reference numerals are used and only differences are described. In addition, the optional features described in relation to FIG. 1 can also be applied to the fitting of FIGS. 2–4.

The chassis 2 is just slightly higher than the blades of the ceiling 1, and is provided with top lips 11 which rest on top of the blades. The length of the chassis 2 can be 210 mm, the length of the reflectors 6,7,8 being 140 mm (maximum).

The chassis 2 is formed as an aluminium extrusion together with the reflectors 6 and 8. The web between the reflectors 6,8 can be pierced (drilled or cut-away) to allow circulation of air. FIGS. 2 and 3 show slightly different web profiles and FIG. 3 illustrates that it is merely necessary that the reflectors 6 and 8 should have their adjacent edges connecting or overlapping as seen looking along a line passing through the filament 5*a*. The chassis has a steel top plate 12 rivetted to lips on steel end plates 13, the end plates 13 being retained by two screws 14 at each end screwing into supporting aluminium castings 15. The castings 15 are e.g. screwed to the reflector 8. The castings mount mild steel pins 16 which engage the profiling 10 on the reflector 7 to provide a pivot action. The reflector 7 is biased anticlockwise (FIG. 3) by one or more hair-springs 17—in the fitting shown, there may be two hair-springs 17, one at each end, the castings 15 being slightly cut back opposite the profiling 10 to accommodate the hair-springs 17. The casting 15 act as the stop to retain the reflector 7 in the correct position. The outer (lower) profile of the reflector 7 is provided for aesthetic reasons.

There is no height adjustment for the lamp holders 3. They are held at each end in a tunnel in the respective casting 15. As the castings 15 are relatively large, they drain heat away from the ends of the lamp 5, thereby enabling the fitting to be smaller whilst preventing temperature limits being exceeded. One possible holder 3 is shown in detail in FIG. 4. There is a ceramic cap 18 carrying a terminal 19 which supports the end of the lamp 5. The cap 18 is biased by a spring 20 away from a ceramic piece 21. The holder 3 is retained by a metal plate 22 held on the casting 15 e.g. by pins on the casting 15 passing through holes in the plate 22, locked by star lock washers.

There is no separate front (right-hand) shield for the reflector 8, the edge of the reflector 8 acting as its own shield.

I claim:

1. A ceiling light fitting for lighting a wall, comprising:

means for mounting the fitting in the ceiling;

holding means for holding a lamp in the fitting with its light source roughly at ceiling level;

an extended reflector for extending substantially parallel to the wall, the shape of the reflector surface as seen in section at right angles to the wall being substantially constant wherever the section is taken along the length of the reflector, the reflector facing generally downwards and having at least its major part positioned above the level of the light source and on the wall side of the light source, the said shape of the reflector as seen in the said section being generally concave and arranged to direct reflected light towards the base portion of the wall.

2. The light fitting of claim 1, wherein the reflector surface is generally parabolic with the light source substantially at its focus.

3. The fitting of claim 1, wherein the said extended reflector has a non-specular surface, for diffused reflection.

4. The light fitting of claim 1, wherein the edge of the said extended reflector which is nearer the wall is arranged to be approximately at the same level as the ceiling.

5. The light fitting of claim 1, wherein the holding means is for holding a lamp with a linear light source with the light source arranged to extend parallel to the wall.

6. The light fitting of claim 1, and further comprising at least one additional extended reflector, of concave curved section, for extending substantially parallel to the wall, positioned in relation to the lamp holding means for reflecting light back through the lamp.

7. The light fitting of claim 6, wherein said additional reflector is of substantially part-circular section, centred substantially on the light source.

8. The light fitting of claim 6, wherein at least part of at least one said additional reflector can be moved aside for replacement of the lamp.

9. The light fitting of claim 6, wherein at least part of at least one said additional reflector acts as masking means for preventing the light source being seen from positions which are on the other side to the wall of the vertical through the light source.

10. The light fitting of claim 9, wherein said first-mentioned extended reflector terminates adjacent the vertical through the light source, and the or each said additional reflector has its major part on the remote side of the light source from the wall, said additional reflector or reflectors comprising an upper portion extending above the level of the light source, the adjacent edges of said upper portion and of the first-mentioned reflector being spaced apart and either substantially coinciding or overlapping as seen looking along a line passing through the light source, and a lower portion extending below the level of the light source to act as the said masking means as well as a reflector.

11. The light fitting of claim 10, wherein the said upper portion terminates above the edge of the first-mentioned reflector and is of a greater radius than the said lower portion, the difference in radii being approximately equal to the distance between the reflecting surfaces of said upper portion and said first-mentioned reflector where they overlap.

12. The light fitting of claim 10, wherein the said first-mentioned extended reflector and the said upper portion are formed as a single metal extrusion and the said lower portion is formed as another metal extrusion.

* * * * *